US007950316B2

(12) United States Patent
Koskovich

(10) Patent No.: US 7,950,316 B2
(45) Date of Patent: May 31, 2011

(54) AUTOMATED SYSTEM FOR PRECISION CUTTING SHORT PIECES OF LUMBER

(75) Inventor: Jerome E. Koskovich, Byron, MN (US)

(73) Assignee: Mitek Holdings, Inc., Wilmington, DE (US)

( * ) Notice: Subject to any disclaimer, the term of this patent is extended or adjusted under 35 U.S.C. 154(b) by 57 days.

(21) Appl. No.: 11/427,332

(22) Filed: Jun. 28, 2006

(65) Prior Publication Data

US 2006/0288831 A1 Dec. 28, 2006

Related U.S. Application Data

(60) Provisional application No. 60/796,337, filed on Apr. 28, 2006, provisional application No. 60/694,780, filed on Jun. 28, 2005.

(51) Int. Cl.
*B26D 7/02* (2006.01)
*B25B 1/24* (2006.01)

(52) U.S. Cl. ..... 83/452; 83/453; 83/454; 83/465; 83/466; 269/269

(58) Field of Classification Search ... 83/78, 472–471.3, 83/35, 801, 451–456, 458–460, 465, 466, 83/471–473; 269/269; 81/426; 198/345.1
See application file for complete search history.

(56) References Cited

U.S. PATENT DOCUMENTS 272,193 A * 2/1883 Beard ..... 269/251
703,328 A * 6/1902 Webber ..... 56/471
805,506 A * 11/1905 Warren et al. ..... 81/413
1,426,026 A * 8/1922 Webster ..... 72/474
1,800,898 A 4/1931 Monberg
2,392,310 A * 1/1946 Chrestoff ..... 269/271
2,477,335 A * 7/1949 Isele ..... 81/426
2,484,339 A * 10/1949 Fuhr ..... 269/139
2,553,802 A * 5/1951 Woods ..... 269/268
2,744,639 A 10/1953 Evans
2,850,144 A 9/1958 Engleson et al.
3,079,963 A 3/1963 Jensen
3,195,740 A 7/1965 Lange et al.
3,223,405 A * 12/1965 Wilson ..... 269/137
(Continued)

FOREIGN PATENT DOCUMENTS

DE 3842085 C1 * 8/1989
(Continued)

OTHER PUBLICATIONS

International Search Report for analogous application No. GB0708114.4 dated Aug. 16, 2007.

*Primary Examiner* — Jason Daniel Prone
(74) *Attorney, Agent, or Firm* — Senniger Powers LLP

(57) ABSTRACT

An automated saw system, including a saw head movable in a cutting stroke and rotatable in angle to perform miter cuts and a lumber feed conveyor to feed lumber to be cut to the saw head. The short lumber member conveyor has a floating gripping assembly that is shiftable along a substantially linear path that is substantially parallel to the lumber long axis whereby a short lumber member cut from the lumber is supported by the short lumber member conveyor during at least part of a cutting process and, after the cutting process is complete, is conveyed from the vicinity of the saw head to an out-feed area for removal.

15 Claims, 9 Drawing Sheets

U.S. PATENT DOCUMENTS 3,247,963 A 4/1966 Fehely
3,329,181 A 7/1967 Buss et al.
3,340,754 A * 9/1967 Burchett ..... 81/356
3,466,958 A 9/1969 Munson
3,491,809 A 1/1970 Schneider
3,498,503 A 3/1970 Hellstrom et al.
3,566,936 A 3/1971 Golick
3,601,266 A 8/1971 Pearne et al.
3,615,001 A 10/1971 Temple
3,622,149 A 11/1971 Enskat
3,630,512 A * 12/1971 Paret ..... 269/48
3,685,129 A 8/1972 Jureit et al.
3,735,907 A * 5/1973 Kuchar et al. ..... 83/465
3,811,353 A 5/1974 Miles
3,861,664 A * 1/1975 Durkee ..... 269/258
3,910,142 A 10/1975 Jureit et al.
3,970,128 A 7/1976 Kohlberg
3,983,403 A 9/1976 Dahlstrom et al.
4,023,605 A 5/1977 Hellstrom et al.
4,052,046 A * 10/1977 Mortoly ..... 269/208
4,068,834 A 1/1978 Mortoly
4,093,007 A 6/1978 Hellstrom
4,100,949 A 7/1978 Carter
4,106,380 A 8/1978 Stubbings
4,114,868 A * 9/1978 Smith ..... 269/136
4,120,333 A 10/1978 Hellgren et al.
4,134,578 A * 1/1979 Stanley ..... 269/258
4,185,672 A 1/1980 Vit et al.
4,195,737 A 4/1980 Rysti
4,219,120 A 8/1980 Rysti
4,220,115 A 9/1980 Brossman et al.
4,241,906 A * 12/1980 Cole ..... 269/906
4,281,696 A 8/1981 Howard et al.
4,305,538 A 12/1981 Schultz
4,317,398 A 3/1982 Jones et al.
4,339,972 A * 7/1982 Wepner et al. ..... 83/76.8
4,392,204 A 7/1983 Prim et al.
4,394,800 A * 7/1983 Griset ..... 83/614
4,399,849 A 8/1983 Nowakowski
4,448,406 A * 5/1984 Hallberg et al. ..... 269/224
4,484,675 A 11/1984 Doherty et al.
4,503,798 A 3/1985 Hergeth
4,573,862 A 3/1986 Anderson
4,588,006 A 5/1986 Jangaard
4,787,178 A * 11/1988 Morgan et al. ..... 198/468.2
4,794,963 A 1/1989 Oppeneer
4,858,902 A * 8/1989 Hickman ..... 269/221
4,879,752 A 11/1989 Aune et al.
4,926,917 A 5/1990 Kirbach
4,936,437 A 6/1990 Gearhart
4,958,818 A * 9/1990 Buchter ..... 269/136
4,961,702 A * 10/1990 Kern ..... 269/254 CS
4,977,805 A 12/1990 Corley, III
5,022,636 A * 6/1991 Swann ..... 269/43
5,042,341 A 8/1991 Greten et al.
5,088,363 A 2/1992 Jones et al.
5,092,572 A * 3/1992 Litwak et al. ..... 5/600
5,149,071 A * 9/1992 Oliveira ..... 269/271
5,163,663 A * 11/1992 Harris ..... 269/210
5,208,962 A 5/1993 Walker, Jr.
5,335,790 A 8/1994 Geiger et al.
5,353,910 A * 10/1994 Harris et al. ..... 198/345.1
5,358,372 A 10/1994 Meredith
5,374,041 A * 12/1994 Bernstein ..... 269/136
5,381,712 A 1/1995 Head, Jr. et al.
5,417,265 A 5/1995 Davenport et al.
5,605,216 A 2/1997 Raybon et al.
5,685,410 A 11/1997 Ritola et al.
5,992,484 A 11/1999 Jackson
6,059,091 A 5/2000 Maier et al.
6,089,135 A 7/2000 Murray
6,149,146 A * 11/2000 Pleban ..... 269/246
6,238,175 B1 5/2001 Gotz et al.
6,379,105 B1 4/2002 Aylsworth
6,460,440 B1 * 10/2002 Tsune ..... 83/720
6,539,830 B1 * 4/2003 Koskovich ..... 83/13
6,557,692 B2 5/2003 Runonen
6,612,475 B2 * 9/2003 Chen ..... 226/126
6,698,159 B2 * 3/2004 Harris et al. ..... 83/247
6,702,096 B2 * 3/2004 Koskovich et al. ..... 144/414
7,011,006 B2 * 3/2006 Koskovich ..... 83/422
7,163,201 B2 * 1/2007 Bernstein ..... 269/32
7,870,879 B2 * 1/2011 Koskovich ..... 83/75.5
2002/0127093 A1 9/2002 Aylsworth
2003/0192412 A1 10/2003 Otto et al.
2004/0002787 A1 1/2004 Koskovich
2004/0222580 A1 * 11/2004 Hexamer, Jr. ..... 269/277
2005/0120840 A1 * 6/2005 Koskovich ..... 83/422
2005/0248074 A1 * 11/2005 Ray Avalani ..... 269/6
2007/0283546 A1 * 12/2007 Koskovich et al. ..... 29/401.1
2008/0012190 A1 * 1/2008 Koskovich ..... 269/42
2008/0184856 A1 * 8/2008 Koskovich ..... 83/76.8
2009/0084468 A1 * 4/2009 Koskovich et al. ..... 269/37

FOREIGN PATENT DOCUMENTS

EP 1642663 A1 * 4/2006
EP 1738852 A1 1/2007
EP 1864769 A1 * 12/2007
FR 2816235 A1 5/2002
GB 2437648 A * 10/2007
SU 414086 2/1974
SU 1146196 A 3/1985
WO WO 02059019 A2 * 8/2002
WO WO 2007002788 A2 * 1/2007

* cited by examiner

AUTOMATED SYSTEM FOR PRECISION CUTTING SHORT PIECES OF LUMBER

RELATED APPLICATIONS

This application claims priority to U.S. Provisional patent application filed Jun. 28, 2005, Ser. No. 60/694,780, entitled AUTOMATED SYSTEM FOR PRECISION CUTTING CROOKED LUMBER, with Jerome Koskovich as the inventor. This application also claims priority to U.S. Provisional patent application filed Apr. 28, 2006, entitled AUTOMATED SYSTEM FOR PRECISION CUTTING SHORT PIECES OF LUMBER, having Ser. No. 60/796,337, also with Jerome Koskovich as the inventor. Both of the above applications are incorporated herein by reference.

FIELD OF THE INVENTION

The invention generally relates to automated lumber cutting systems. More particularly the invention relates to precision cutting of short sections of lumber.

BACKGROUND OF THE INVENTION

Rising labor costs and demands for more time and cost efficient construction have made it desirable to construct building components and modules off site at specialized fabrication facilities. With wood frame structures, especially prefabricated residential structures, there are great economies to be realized by providing automated equipment that can measure and cut lumber components utilized in wall panels, roof trusses, and other prefabricated structures. Where a particular structural element is repeated over and over the use of such automated equipment can decrease construction time and lower cost. The economies of this approach are even more appealing for custom structural designs. For wood frame structures where the framing is constructed on site, precutting and marking lumber at an off site location can create a kit design minimizing measuring, sawing, and the need for specialized labor on site. This can result in faster construction as well as minimized cost. On site construction errors can also be minimized.

The use of prefabricated trusses or panels also minimizes construction delays due to the interference of bad weather at the construction site. Trusses and panels can be constructed in a controlled indoor environment without weather affecting the efficiency of the workers and equipment involved.

Prefabricated roof trusses in particular, generally include multiple pieces of lumber that must be precision cut to specific lengths as well as having precision mitered ends to form tight fitting joints. A typical roof truss includes two top chords, a bottom chord, several webs and may also include wedges and overhangs. Many of these pieces require a preparation of mitered cuts at the ends of the lumber pieces. Many of the pieces will require multiple mitered cuts on an end. For a truss to achieve its maximum structural integrity and strength the joints between the various wooden parts must be tight fitting. Thus, precision cutting of truss members is quite important to creating a truss that meets engineering standards.

In response to these needs, the process for cutting and mitering truss members, in many circumstances, has been automated for improved precision, speed and efficiency.

Prefabricated roof trusses in particular, generally include multiple pieces of lumber that must be precision cut to specific lengths as well as having precision mitered ends to form tight fitting joints. As depicted in FIG. 1, a typical roof truss includes two top chords TC, a bottom chord BC, several webs WB and may also include wedges WD and overhangs O.

As can be seen by examining FIG. 1, many of these pieces require a preparation of mitered cuts at the ends of the lumber pieces. Many of the pieces will require multiple mitered cuts on an end. For a truss to achieve its maximum structural integrity and strength the joints between the various wooden parts must be tight fitting. Thus precision cutting of truss members is quite important to creating a truss that meets engineering standards.

Thus, the process for cutting and mitering truss members, in many circumstances, has been automated for improved precision.

In particular, when cutting lumber for roof trusses some of the lumber members can be quite short. Some lumber members in roof trusses may be as short as six inches.

While currently existing automated measuring and cutting equipment can cut pieces of lumber to this length, current equipment has certain limitations. For example, once a short lumber member is cut it generally drops into a scrap bin because much currently available lumber cutting equipment has no way of conveying short lumber members once they are cut.

Another limitation of currently available automated measuring and cutting equipment is that once a single cut severing the short lumber member from a longer lumber member is made it is not possible for the automated equipment to make further cuts in that short lumber member. For example, if a 12 inch lumber member is required with two mitered cuts on each end, current automated equipment can perform the two mitered cuts on the first end without difficulty and then advance a longer section of lumber from which the short member is being cut to a position where the third cut can be made. Once the third cut is made however, the short lumber member drops into a scrap bin and is no longer available for making the fourth cut. Thus the fourth cut either must be made by hand or the short member must be manually prepared in its entirety.

Another limitation of the existing equipment is that because short lumber members are not conveyed further once they are cut but drop into the scrap bin along with true scrap pieces of material to be discarded the desired short lumber members must be sorted out by an operator from the true scraps in the bin. With very short lumber members it may be very difficult to discern what members are in fact scrap to be discarded and what lumber members are in fact usable pieces that must be retrieved.

Thus, the automated lumber cutting industry would benefit from a system for handling short pieces of lumber while still retaining the ability to make precision cuts on the short lumber members.

SUMMARY OF THE INVENTION

In one aspect of the present invention, an automated saw system for cutting a piece of lumber generally comprises a saw for cutting a piece of lumber and a carrier located relative to the saw and moveable in a direction for positioning the piece of lumber for cutting by the saw. The carrier is adjustable in a direction substantially orthogonal to said direction of movement.

In another aspect of the present invention, a method of cutting a short piece of lumber generally comprises securing a piece of lumber between jaws of a carrier. The piece of lumber is conveyed to a saw in a direction substantially parallel to a longitudinal axis of the piece of lumber. At least one of the jaws of the carrier is adjusted in a direction substantially orthogonal to the conveying direction of the piece of lumber. The piece of lumber is cut.

Other features of the present invention will be in part apparent and in part pointed out hereinafter.

BRIEF DESCRIPTION OF THE DRAWINGS

Corresponding characters indicate corresponding parts throughout the several views of the drawings.

DETAILED DESCRIPTION OF THE DRAWINGS

Figure 7:
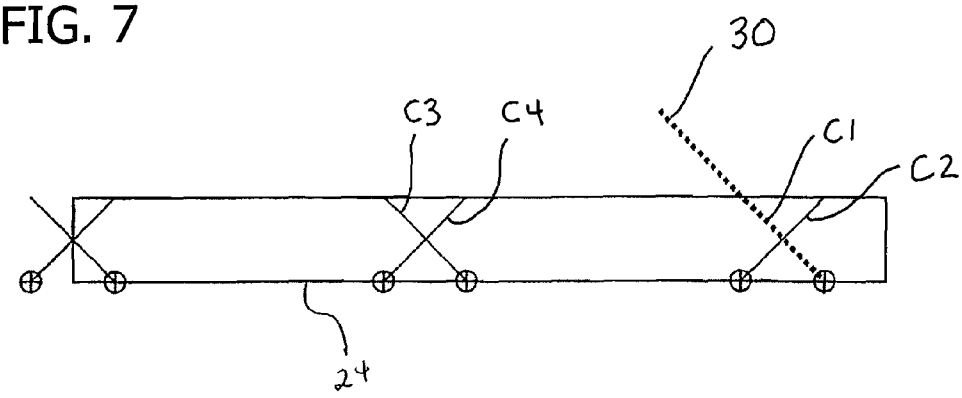
FIG. 7 is a schematic depiction of exemplary cuts to be made in a lumber member in accordance with the present invention.
Figure 8:
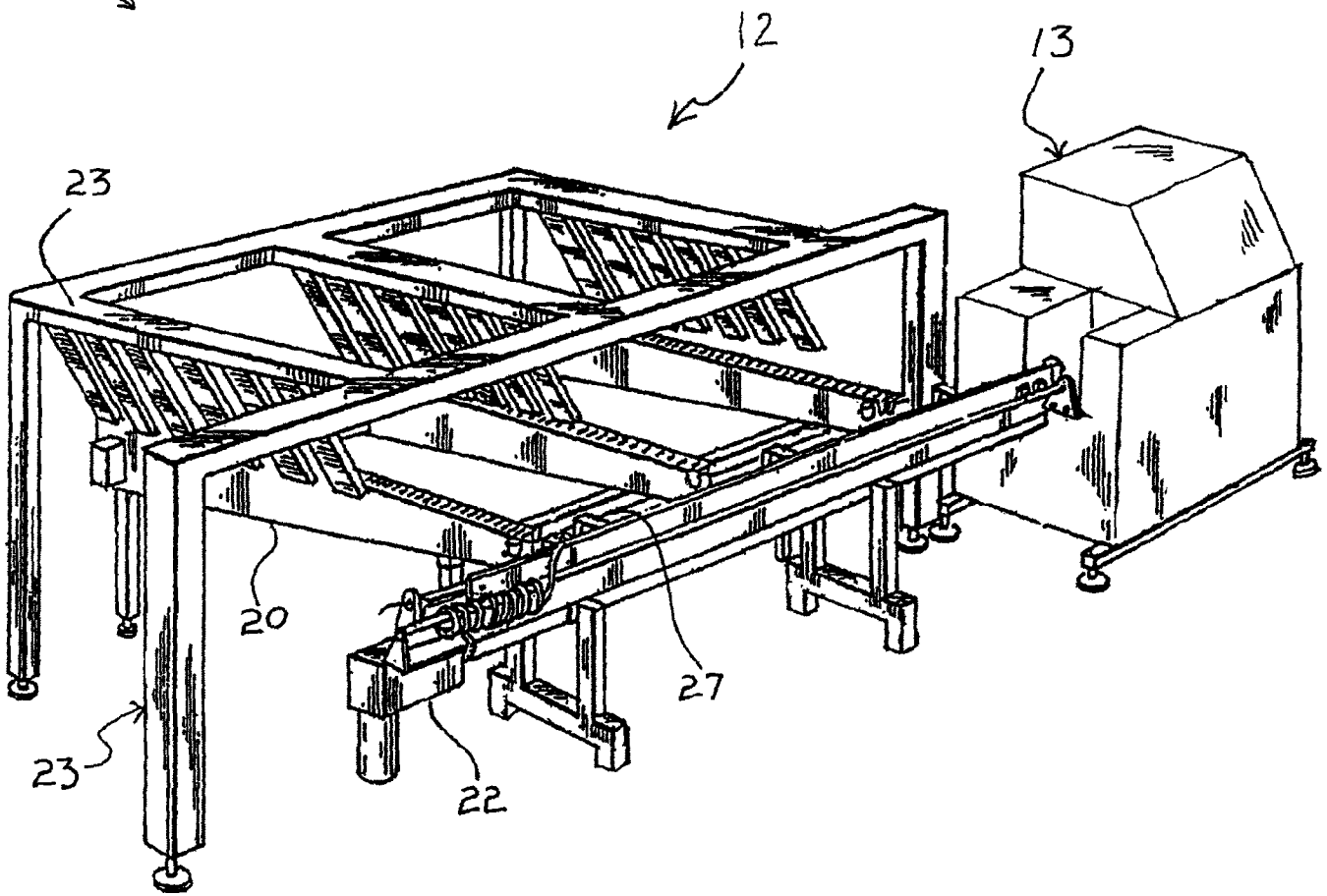
FIG. 8 is a perspective view of an exemplary automated saw system in accordance with the invention.

Referring to FIGS. 2, 3A, 3B, and 8, the automated saw system 10 of the present invention is generally shown. As shown in FIG. 8, it generally includes lumber feed conveyor 12 and saw station 13. Lumber feed conveyor 12 generally includes transverse conveyor portion 20 and longitudinal conveyor portion 22. Lumber feed conveyor 12 transports lumber members (not shown in FIG. 7) to the saw station 13 for cutting. Lumber feed conveyor 12 transports lumber members from a magazine feeder 23, a bunk feeder (not shown) or another source of supply for lumber members. Transverse conveyor portion 20 receives lumber members from the magazine feeder 23 and transports them in a direction transverse to their longitudinal axes to the longitudinal conveyor portion 22. Further details of conveyor portions, process controllers, and operational details may be found in U.S. Pat. No. 6,539,830, owned by the owner of the instant application and incorporated herein by reference. "Boards", "lumber", and "lumber members" are intended to be interchangeable herein unless the context clearly indicates the contrary.

Longitudinal conveyor portion 22 transports lumber members in a longitudinal direction parallel to their longitudinal axes (see FIG. 2, which illustrates a longitudinal axis 24' of a lumber member 24), to the saw station 13. Longitudinal conveyor portion 22 may include gripper 27 that grips an end of a respective lumber member and precisely positions it for placement of cuts along the lumber member.

Figure 1:
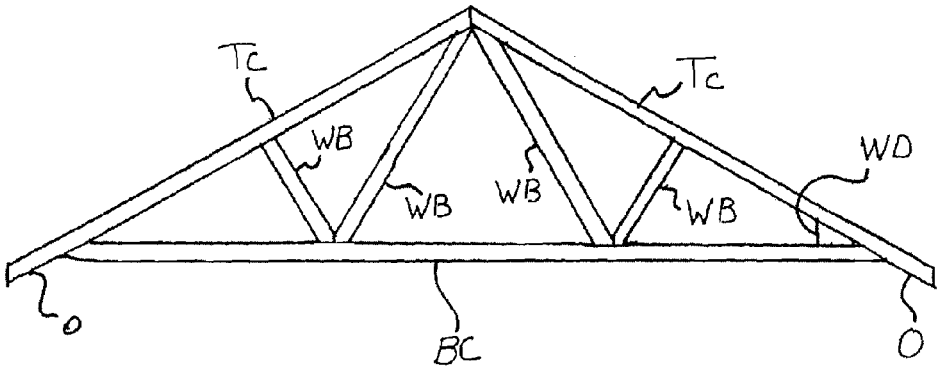
FIG. 1 PRIOR ART
FIG. 1 depicts an exemplary roof truss of the prior art.
Figure 2:
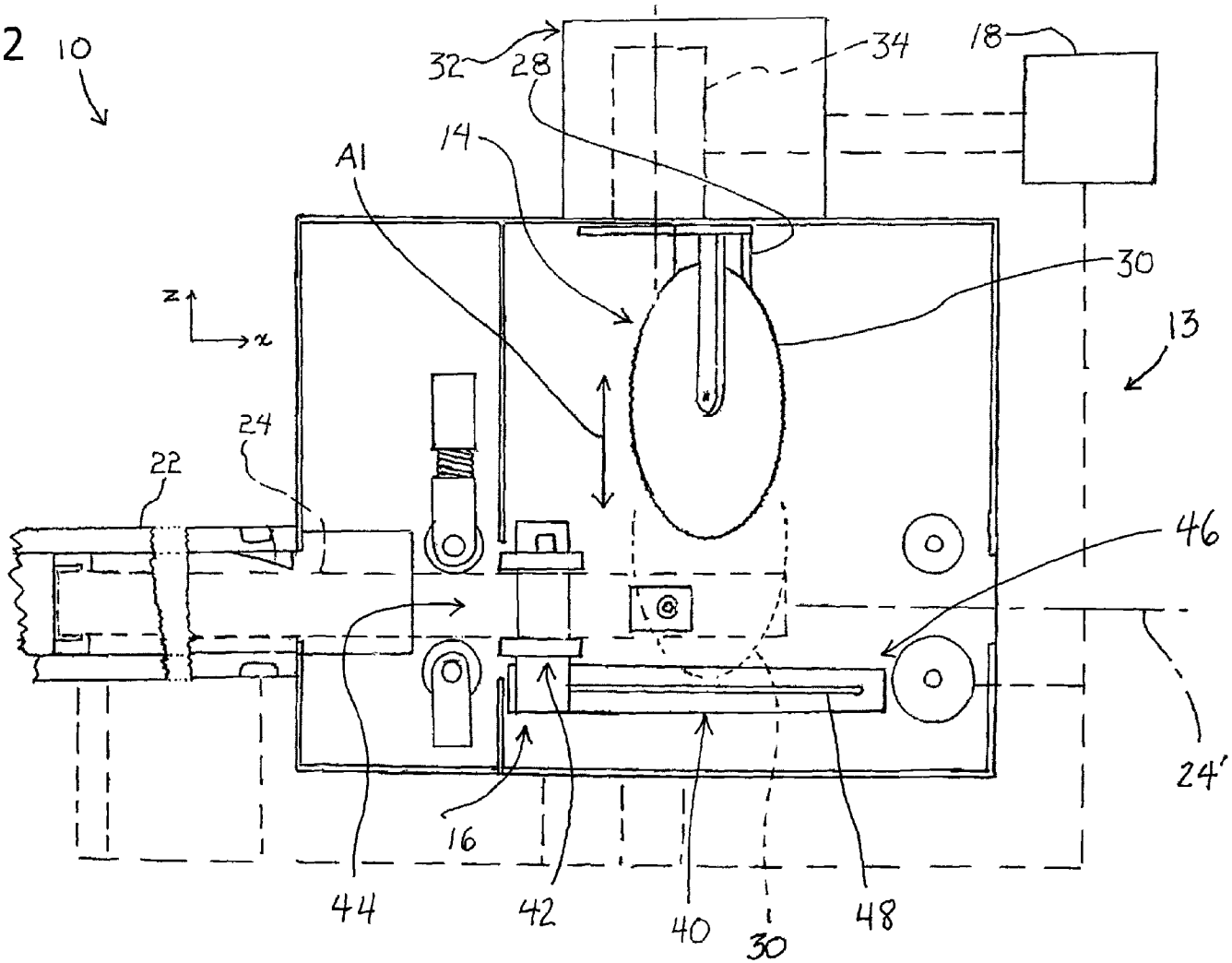
FIG. 2 is a schematic plan view of an automated saw system in accordance with the present invention.
Figure 3A:
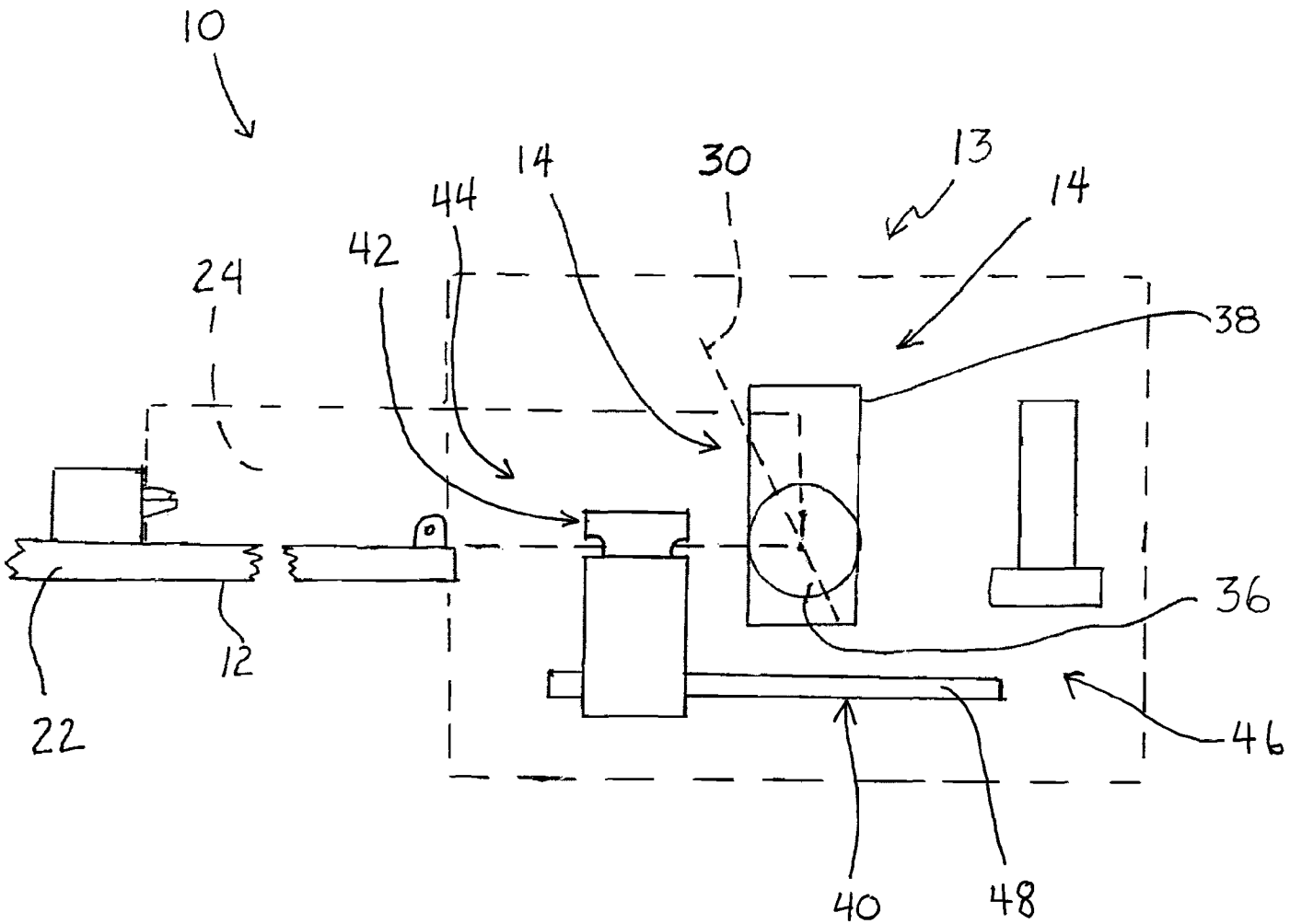
FIG. 3A is a schematic elevation view of the automated saw system.
Figure 3B:
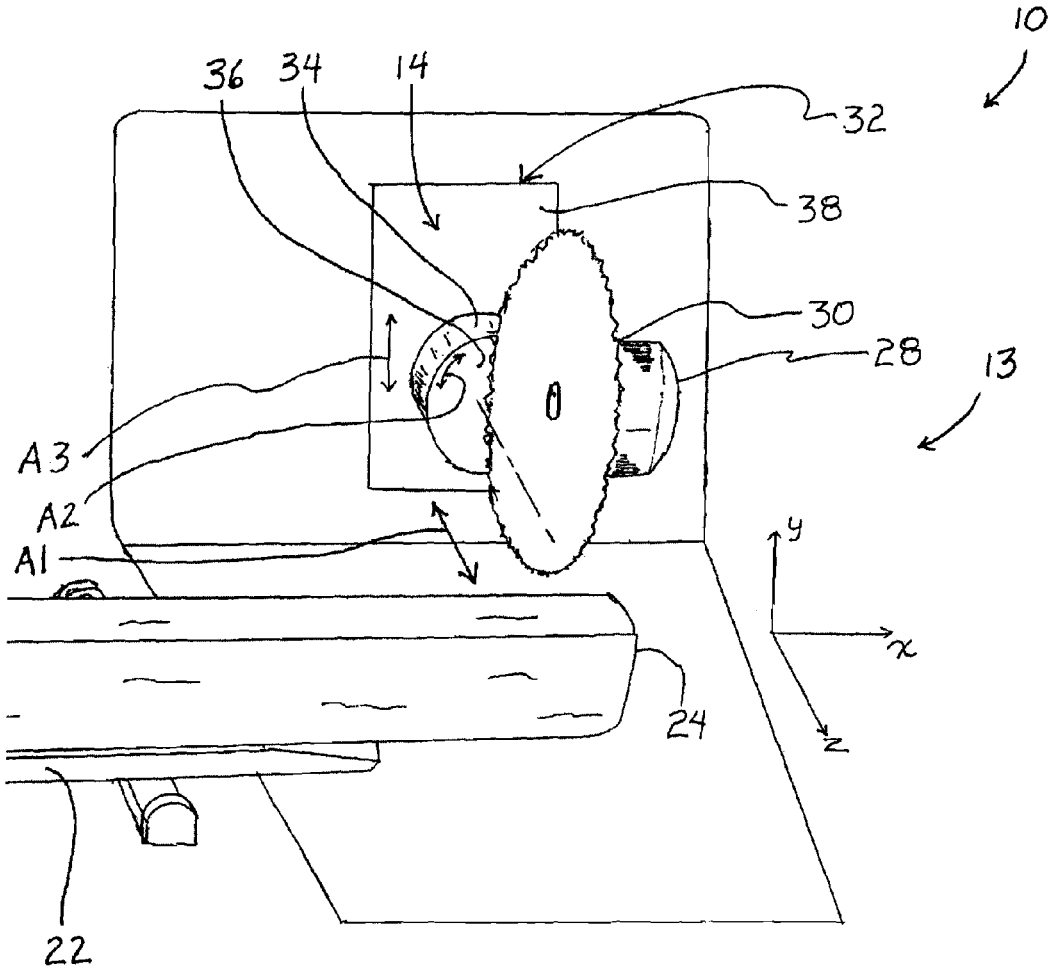
FIG. 3B is an enlarged fragmentary perspective view of the automated saw system.

Referring to FIGS. 2-3B, the saw station 13 generally includes saw 14, short member conveyor 16, and process controller 18. The saw 14 generally includes motor 28, blade 30 and support 32. Saw motor 28 drives saw blade 30. Saw 14 may be a circular-saw based saw as depicted herein, however it is to be understood that saw 14 may include other types of motorized saws or cutters such as a band saw, a reciprocating saw, a laser cutter or a high pressure water cutter. Saw motor 28 may be linked to saw blade 30 via a transmission or reduction drive (not shown.)

Saw support 32 generally includes cutting stroke piston 34, angle adjuster 36, and elevation adjuster 38 (FIG. 3B). Cutting stroke piston 34 may be a pneumatic piston, hydraulic piston, or another form of electromechanical operator that moves saw blade 30 in a cutting stroke as indicated by arrow A1 in FIG. 3B (see also FIG. 2 showing the saw blade 30 moved in broken lines).

Angle adjuster 36 may rotate saw blade 30 about cutting stroke piston 34 as indicated by arrow A2 in FIG. 3B. Desirably angle adjuster 36 is capable of adjusting saw blade 30 from about two degrees from the horizontal to about one hundred seventy eight degrees from the horizontal. Angle adjuster 36 may be based upon pneumatic, hydraulic, electric motor or another suitable actuator adjusting the angle of saw blade 30. Thus the saw blade 30 is moveable in a cutting stroke with adjustment to a miter angle.

Elevation adjuster 38 adjusts the height of saw blade 30 relative to the position of lumber member 24 in the direction as indicated by A3 in FIG. 3B. Elevation adjuster 38 is desirably adjustable in small increments. For example, elevation adjuster 38 may be adjustable in increments of about 0.030 of an inch or approximately one-thirty-second of an inch or about 0.8 millimeters. The adjuster may be, for example, long belts, rack and pinion mechanism, a servo motor, chain drive or other mechanism to translate servo's rotation to the linear elevation adjustment. The saw blade 30, cutting stroke piston 34, and angle adjuster 36 are preferably all elevated by the elevation adjuster 38.

Referring to FIGS. 2-3B and 6, the short lumber conveyor 16 generally includes base assembly 40 and gripper head 42. Base assembly 40 generally includes in-feed end 44, out-feed end 46 and tracks 48. Tracks 48 interconnect in-feed end 44 to out-feed end 46.

Figure 6:
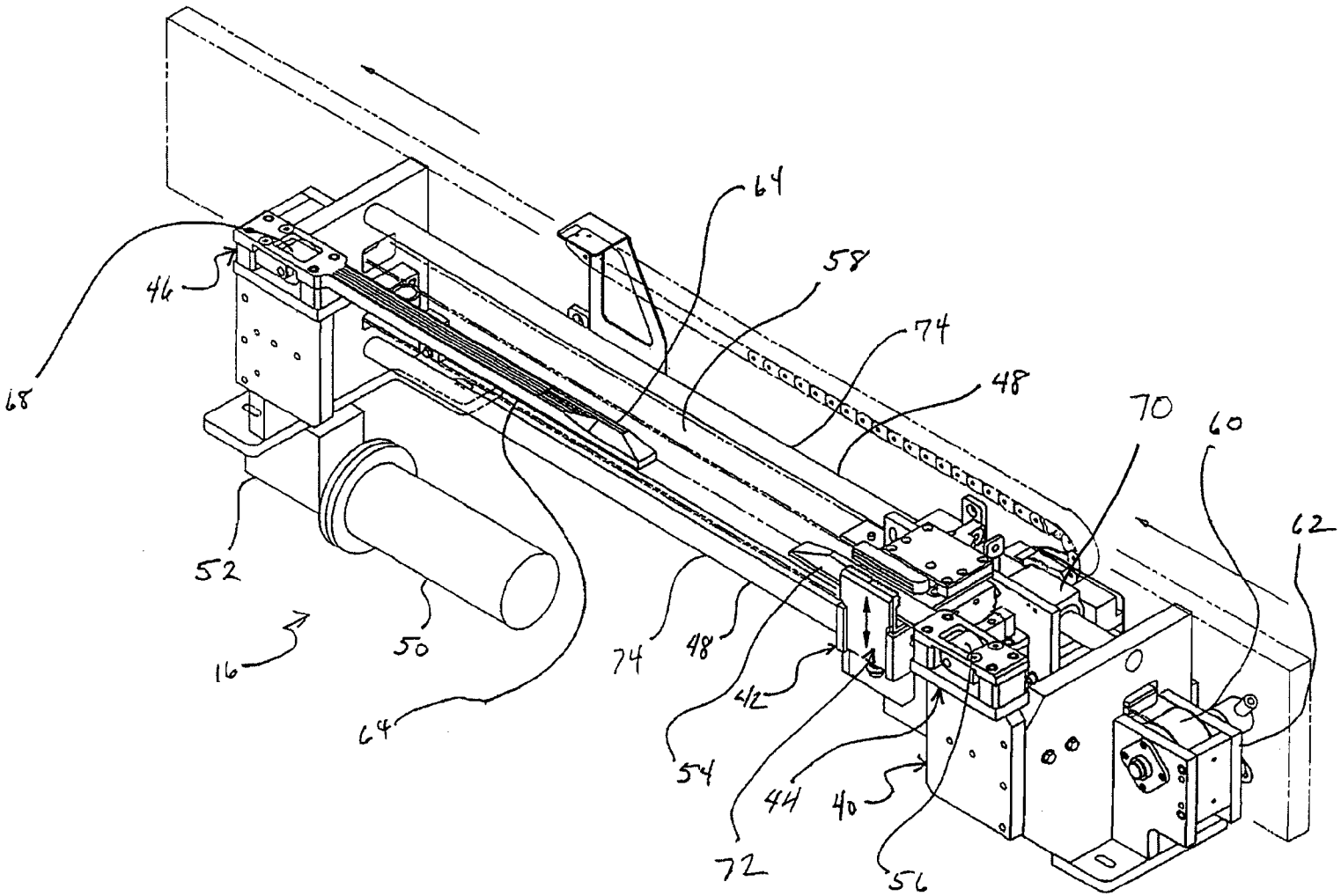
FIG. 6 is a perspective view of a short member conveyor of the automated saw system including a carriage and the floating jaw assembly.

As best shown in FIG. 6, in-feed end 44 generally includes in-feed tongue 54, in-feed roller 56, idler pulley 60, and pulley support 62. In-feed tongue 54 serves to support lumber members at the in-feed end. In-feed roller 56 may be positioned partially surrounded by in-feed tongue 54 as depicted in FIG. 3A.

Out-feed end 46 generally includes actuator motor 50, actuator transmission 52, out-feed tongue 64, and out-feed roller 68. Actuator motor 50 drives belt 58 via actuator transmission 52. Actuator motor 50 operates in two directions and is controlled by a process controller (not shown). Idler pulley 60 supports belt 58. Pulley support 62 supports idler pulley 60. Out-feed tongue 64 is an elongated structure and essentially a mirror image of in-feed tongue 54. Out-feed tongue 64 also may surround out-feed roller 68.

Tracks 48 may include, for example, two straight polished rods upon which gripper head 42 may travel back and forth between in-feed end 44 and out-feed end 46. Tracks 48 may also include other structures that allow the linear translation of gripper head 42 between in-feed end 44 and out-feed end 46.

Gripper head 42 generally includes sliding assembly 70 and gripping assembly 72.

Sliding assembly 70 as depicted here is adapted to slide along rods 74. Sliding assembly 70 may be any sort of assembly, for example a carriage, that allows gripper head 42 to translate substantially linearly between in-feed end 44 and out-feed end 46.

Figure 4:
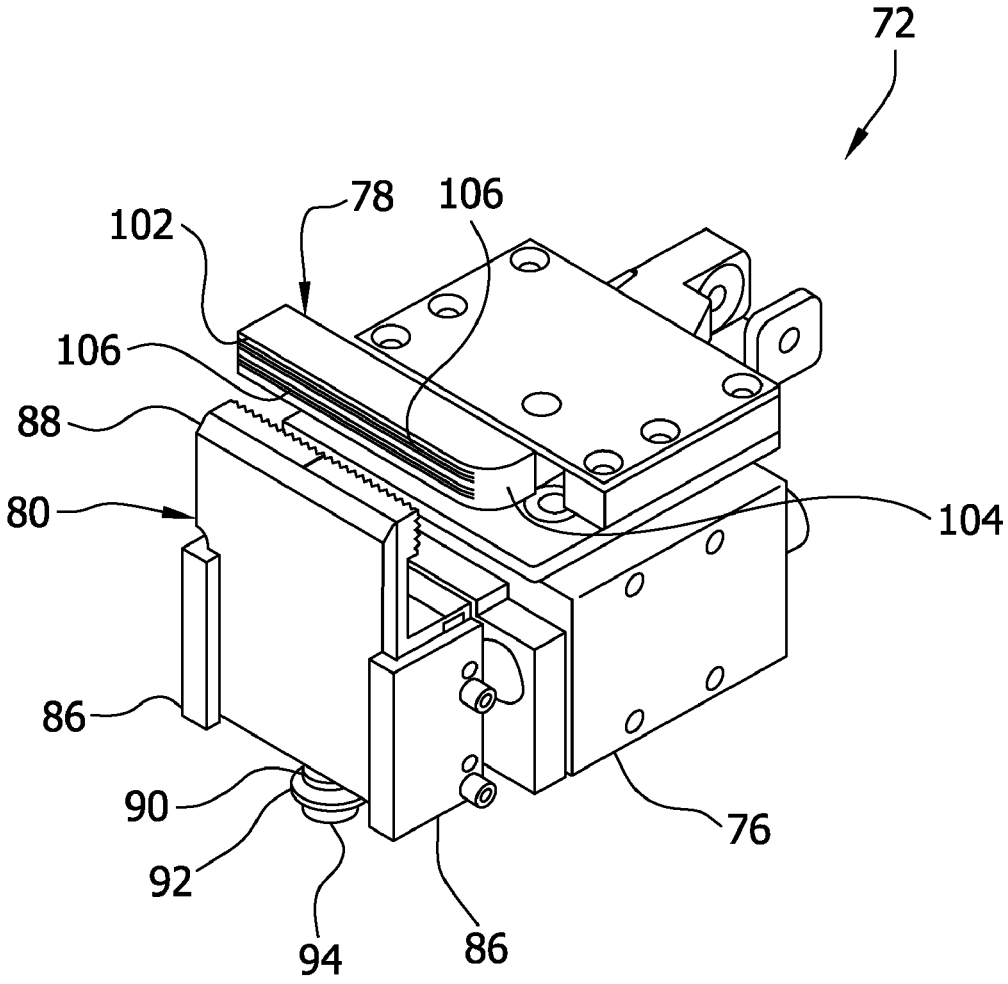
FIG. 4 is a perspective view of a floating jaw assembly of the automated saw system.
Figure 5:
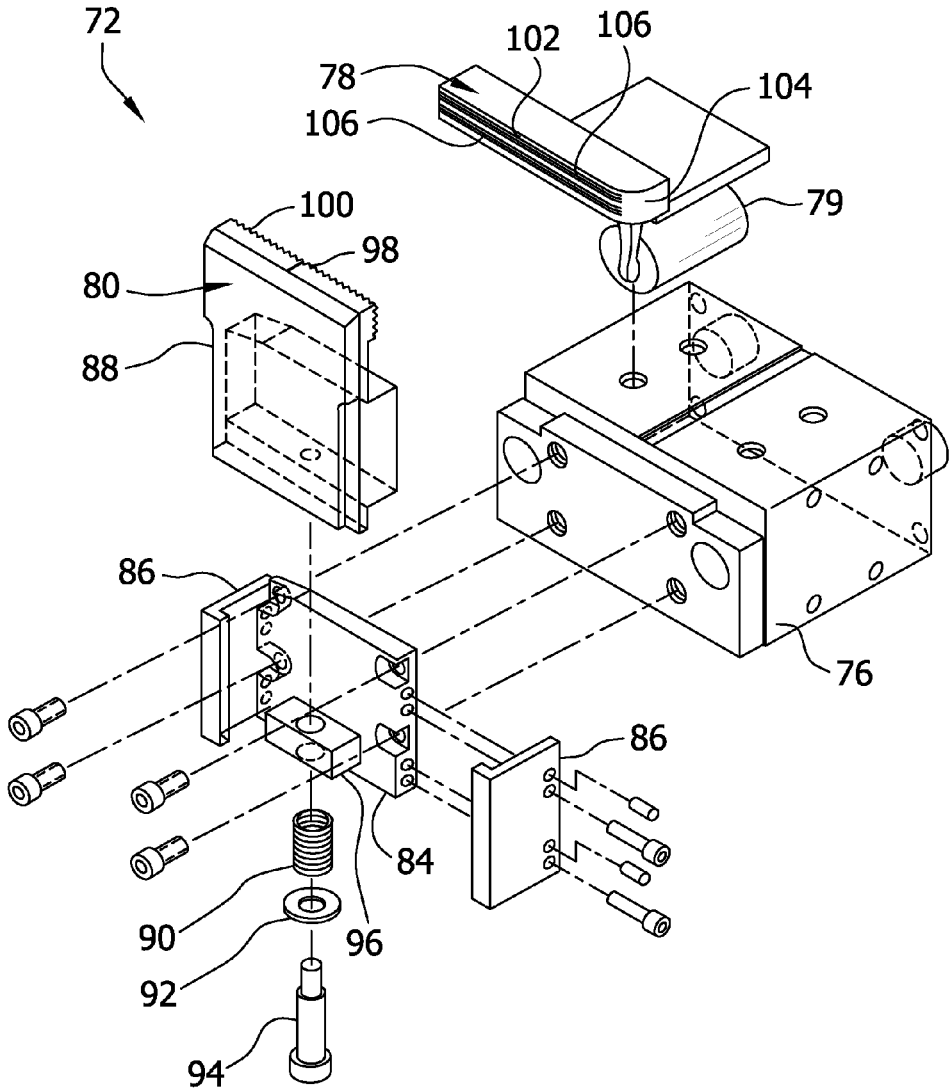
FIG. 5 is a partial exploded perspective view of the floating jaw assembly with parts removed for clarity.

Gripping assembly 72, as best seen in FIGS. 4 and 5, generally includes body 76, active moveable jaw 78, and jaw 80. Moveable jaw 78 is positioned so as to be opposed by jaw 80. Body 76 supports moveable jaw 78 and jaw 80. Moveable jaw 78 is connected to an actuator 79 (FIG. 5), which can be preferably electric or pneumatic, and which moves moveable jaw 78 toward jaw 80 with sufficient force to secure lumber members.

Jaw 80 may float to compensate for warping in lumber members. The floating jaw 80 generally includes plate 84, clamp members 86, jaw member 88, spring 90, washer 92 and bolt 94. In the depicted embodiment, jaw member 88 is held in close opposition with plate 84 by clamp members 86. Jaw member 88 can slide in a vertical direction relative to plate 84. Spring 90 is secured at spring plate 96 by bolt 94 and washer 92 so that the spring tends to bias jaw member 88 in a downward direction. Plate 84 is secured to body 76 to support jaw member 88 generally in opposition to moveable jaw 78.

Jaw member 88 has a serrated face 98 displaying a plurality of sharp corners 100. Moveable jaw 78 has a ridged face 102 displaying rounded protrusions 106 and the movable jaw also has a rounded corner 104.

In operation lumber is fed to automated saw system 10 via the lumber feed conveyor 12. Lumber members 24 are transferred by transverse conveyor portion 20 to longitudinally conveyor portion 22. When a lumber member 24 is in position, saw blade 30 is adjusted by process controller 18 so that saw blade 30 is in proper position based on operation of miter adjuster 36 and elevation adjuster 38. A cutting stroke is performed via cutting stroke piston 34.

When it is desired to cut a short lumber member 24, gripper head 42 transits to in-feed end 44 of base assembly 40. At this point gripper head 42 grips lumber member 24.

To grip lumber member 24, moveable jaw 78 is moved toward jaw 80. Jaw member 88 is brought into contact with lumber member 24 so that serrated face 98 tightly grips lumber member 24. Ridged face 102 of moveable jaw 78 grips lumber member 24 but allows more slippage than serrated face 98. Jaw 78 could be adopted to float within the scope of the invention.

Referring also to FIG. 7, after desired miter cuts C1, C2 are made on a leading edge of lumber member 24, lumber member 24 is advanced so that gripping assembly 72 is moved toward out-feed end 46. Thus, gripping assembly 72 is beyond saw blade 30 for the making of trailing edge cuts.

After an initial trailing edge cut C3 is made by saw blade 30, gripping assembly 72 moves toward out-feed end 46 to position lumber member 24 for a second trailing edge cut C4 if needed. Cutting stroke piston 34 is actuated to perform a cutting stroke thus making a second or further miter cut on the trailing edge of short lumber member 24. Once the tailing edge cuts on lumber member 24 are completed, gripping assembly 72 moves further toward out-feed end 46 of short lumber conveyor 16.

Thus, short lumber member 24 is transferred from gripping assembly 72 to be supported by out-feed tongue 64 and out-feed roller 68.

If short lumber member 24 is cut from a lumber member 24 that is warped or otherwise not straight, short lumber member 24 may become pinched against out-feed tongue 64 or out-feed roller 68. When this occurs, floating jaw 80 can move in an upward direction because of the resilient bias of spring 90. Thus, preventing damage to short lumber member 24 while exiting over out-feed tongue 64 and out-feed roller 68. Once short lumber member 24 is positioned on out-feed tongue 64 and out-feed roller 68 gripping assembly 72 releases short lumber member 24 and another cycle can begin.

The automated lumber cutting system of the present invention solves many of the above-discussed problems. By way of summarizing the foregoing, the automated lumber cutting system of the present invention generally includes a transverse lumber conveyor, a longitudinal lumber conveyor, a saw head and a short member conveyor having a floating head.

The transverse lumber conveyor of the present invention transports and loads lumber members to be cut into the longitudinal lumber conveyor. The transverse lumber conveyor transports lengthy lumber members in a direction transverse to their longitudinal axis from a storage area or magazine which feeds the lumber members.

The longitudinal lumber conveyor moves the lumber members in a direction parallel to their long axis and feeds the lumber members to the saw head for cutting. The longitudinal lumber conveyor is capable of precisely positioning lumber members for marking and cutting.

Once the longitudinal conveyor positions a lumber member, the saw head can execute a cutting stroke. The saw head is desirably oriented so that the cutting stroke is horizontal and substantially perpendicular to the long axis of the lumber member.

The saw head is also capable of rotation about the stroke axis or an axis parallel to the stroke axis to allow positioning of the saw blade for miter cuts of the lumber members. In addition, the saw head may be adjustable in a vertical direction perpendicular to the saw stroke axis in order to allow for multiple miter cuts to be made as desired on wide pieces of lumber fed to the saw head.

The short member conveyor generally includes a gripping head capable of gripping the lumber member and separating the a short lumber member from the long lumber member and precisely positioning it relative to the saw head to allow for making of multiple mitered cuts on the trailing end of the short lumber member. In one embodiment of the invention, the gripping head includes a floating gripper jaw as described previously herein that can move vertically to compensate for warped or bowed lumber that might become pinched in handling equipment.

In view of the above, it will be seen that the several features of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An automated saw system for cutting a piece of lumber, the saw system comprising:

a saw for cutting a piece of lumber;

a carrier located relative to the saw and moveable in a lumber feed direction for positioning the piece of lumber for cutting by the saw, the carrier comprising a movable jaw and a floating jaw, the movable jaw being movable in a clamp direction generally orthogonal to said lumber feed direction, the floating jaw being mounted for floating movement generally within a plane including a floating direction, the floating direction being orthogonal to a horizontal plane including said lumber feed direction and orthogonal to said clamp direction, the movable jaw and floating jaw being adapted to secure the piece of lumber between the jaws, and the floating jaw being adapted to accommodate a shape of the lumber by moving in the floating direction in response to engagement by the lumber.

2. The saw system as set forth in claim 1 wherein the carrier further comprises a spring that biases the floating jaw downward, the floating jaw being movable in said floating adjustment direction against the bias of the spring.

3. The saw system as set forth in claim 1 wherein the carrier is moveable relative to the saw in said lumber feed direction.

4. The saw system as set forth in claim 3 further comprising a substantially linear track, the carrier moving along the track.

5. The saw system as set forth in claim 1 wherein said movable jaw is fixed and immovable in said floating direction.

6. The saw system as set forth in claim 1, wherein the carrier further comprises a mount, the floating jaw being slidingly received in the mount for permitting sliding movement of the floating jaw in the floating direction.

7. An automated saw system for cutting a piece of lumber, the saw system comprising:

a saw for cutting a piece of lumber;

a carrier located relative to the saw and moveable in a lumber feed direction for positioning the piece of lumber for cutting by the saw, the carrier comprising a movable jaw and a floating jaw, the movable jaw being movable in a clamp direction generally orthogonal to said lumber feed direction, the floating jaw being mounted for floating movement within a plane including a floating direction, the floating direction being orthogonal to a horizontal plane including said lumber feed direction and orthogonal to said clamp direction, and a mount mounting said floating jaw for said floating movement in said floating direction, said floating jaw being free to engage in said floating movement relative to the mount, whereby if the piece of lumber is not straight the floating jaw is adapted to move in response to engagement by the piece of lumber to accommodate the not straight piece of lumber as it is fed in said lumber feed direction.

8. The saw system as set forth in claim 7 wherein the mount further comprises a spring that biases the floating jaw downward, the floating jaw being movable in said floating adjustment direction against the bias of the spring.

9. The saw system as set forth in claim 7 wherein the carrier is moveable relative to the saw in said lumber feed direction.

10. The saw system as set forth in claim 9 further comprising a substantially linear track, the carrier moving along the track.

11. The saw system as set forth in claim 7 wherein said movable jaw is fixed and immovable in said floating direction.

12. The saw system as set forth in claim 7 wherein the floating jaw and mount are constructed for reception of the floating jaw in the mount for sliding movement of the floating jaw in the mount in the floating direction.

13. The saw system as set forth in claim 7 wherein the mount captures the floating jaw such that a substantially vertical face of the mount engages a substantially vertical face of the floating jaw.

14. A gripping assembly comprising:

a movable jaw having a face for engaging a workpiece;

a floating jaw having a face generally opposite the movable jaw face for engaging the workpiece to clamp the workpiece between the movable jaw and the floating jaw;

the movable jaw being movable with respect to the floating jaw in a clamp direction toward and away from the floating jaw face, and the floating jaw being mounted for movement relative to the movable jaw within a plane including a floating direction, the floating direction being orthogonal to the clamp direction, the plane of the floating jaw movement being parallel to the movable jaw face, the floating jaw being mounted to move in said floating direction in response to engagement by the workpiece.

15. The gripping assembly as set forth in claim 14 further comprising a spring that biases the floating jaw downward, the floating jaw being movable in said floating adjustment direction against the bias of the spring.

* * * * *